US011459861B1

(12) United States Patent
Hunt et al.

(10) Patent No.: US 11,459,861 B1
(45) Date of Patent: Oct. 4, 2022

(54) DOUBLE BARRIER GAS LIFT FLOW CONTROL DEVICE

(71) Applicant: JMI MFG, Broussard, LA (US)

(72) Inventors: Tommy Hunt, Broussard, LA (US); Matthew Gautreau, Broussard, LA (US); Cody Hunt, Broussard, LA (US)

(73) Assignee: JMI MFG, Broussard, LA (US)

( * ) Notice: Subject to any disclaimer, the term of this patent is extended or adjusted under 35 U.S.C. 154(b) by 0 days.

(21) Appl. No.: 17/531,363

(22) Filed: Nov. 19, 2021

(51) Int. Cl.
*E21B 43/12* (2006.01)

(52) U.S. Cl.
CPC ..... *E21B 43/123* (2013.01)

(58) Field of Classification Search
CPC ..... E21B 43/122; E21B 43/13; E21B 43/123; E21B 43/1235
See application file for complete search history.

(56) References Cited

U.S. PATENT DOCUMENTS

| | | | | | |
|---|---|---|---|---|---|
| 2,178,309 | A * | 10/1939 | Oldham | E21B 43/122 | 417/190 |
| 2,208,036 | A * | 7/1940 | Kyner | E21B 43/122 | 417/54 |
| 2,275,346 | A * | 3/1942 | Bryan | E21B 43/123 | 417/115 |
| RE24,015 | E * | 5/1955 | Walter | E21B 43/122 | 417/112 |
| 2,865,305 | A * | 12/1958 | Vincent | F04B 47/00 | 417/142 |
| 2020/0182027 | A1* | 6/2020 | Romer | E21B 43/122 | |

* cited by examiner

*Primary Examiner* — George S Gray
(74) *Attorney, Agent, or Firm* — FisherBroyles, LLP; Jason P. Mueller

(57) ABSTRACT

Double barrier gas lift flow control devices that utilize first and second check valve assemblies disposed in series. A check valve assembly configured for disposition within an interior of a gas lift flow control device, the check valve assembly having flow channels disposed radially outward from a valve head of the check valve assembly. A check valve assembly configured to engage a nose end of gas lift flow control device.

14 Claims, 11 Drawing Sheets

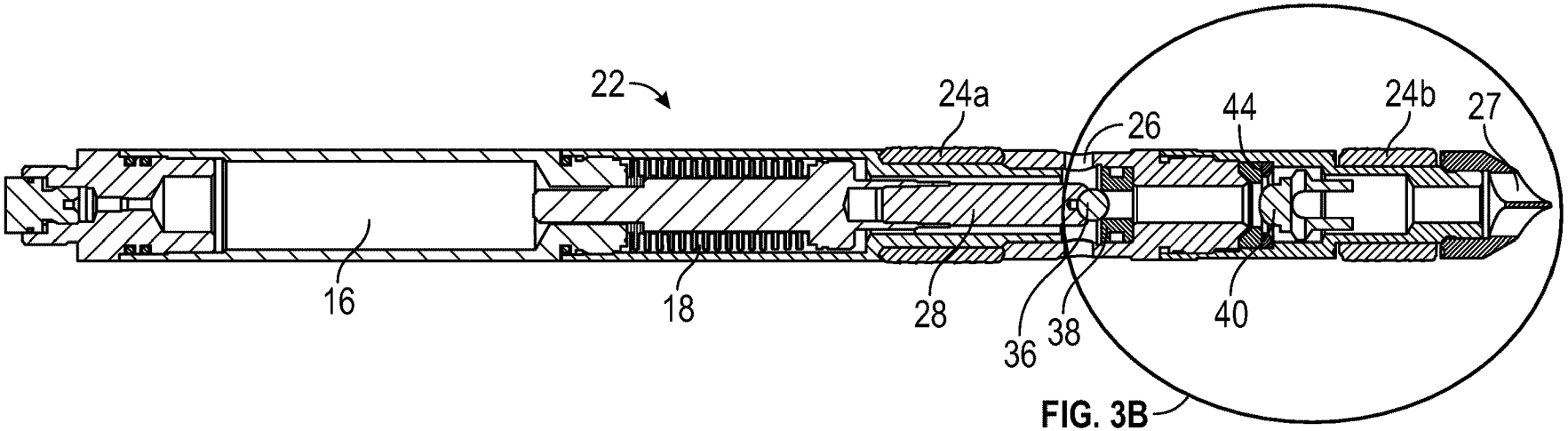
FIG. 3B
FIG. 3A
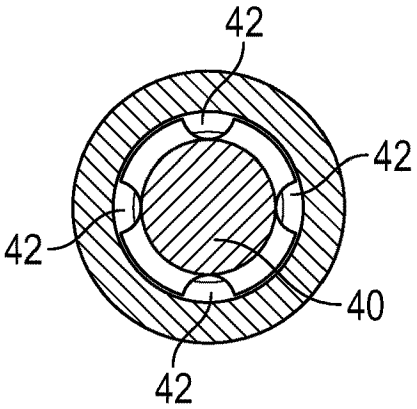
FIG. 3C
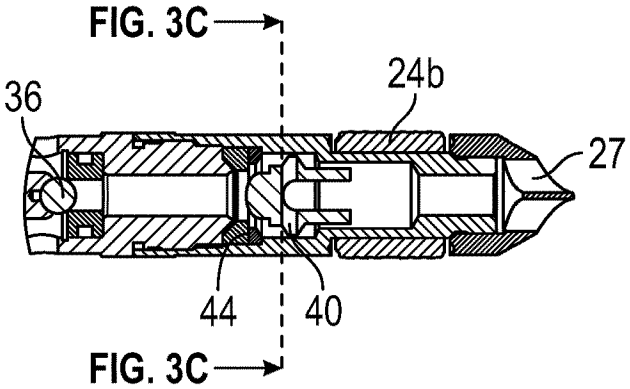
FIG. 3B

DOUBLE BARRIER GAS LIFT FLOW CONTROL DEVICE

FIELD

The present disclosure relates to flow control devices for use with injection valves that inject gas into production tubing of hydrocarbon wells. More specifically, present disclosure relates to various reverse flow check valves that prevent reverse flow through such injection valves.

BACKGROUND

Well bores of hydrocarbon wells extend from the surface to permeable subterranean formations ('reservoirs') containing hydrocarbons. These well bores are drilled in the ground to a desired depth and may include horizontal sections as well as vertical sections. Well casing (e.g., large diameter steel piping) is typically inserted into the well bore. Disposed within the well casing is a string of production piping/tubing, which has a diameter that is less than the diameter of the well casing. The production tubing may be secured within the well casing via one or more packers, which may provide a seal between the outside of the production piping and the inside of the well casing. The production tubing typically provides a continuous bore from the production zone to the wellhead through which oil and gas can be produced.

The flow of fluids, from the reservoir(s) to the surface, may be facilitated by the accumulated energy within the reservoir itself, that is, without reliance on an external energy source. In such an arrangement, the well is said to be flowing naturally. When an external source of energy is required to flow fluids to the surface the well is said to produce by a means of artificial lift. Artificial lift may be achieved using a mechanical device inside the well (e.g., pump) or by decreasing the weight of the hydrostatic column in the production tubing by injecting gas into the liquid within the production tubing.

The injection of gas to decrease the weight of a hydrostatic column is commonly referred to as gas lift, which is artificial lift technique where compressed gas is injected into production tubing to reduce the hydrostatic pressure within the production tubing (e.g., to a pressure below the inlet of the production tubing). The reduced pressure in the production tubing allows liquid therein to rise to the surface more readily. In one gas lift arrangement, high pressure gas is injected into an annular space (i.e., annulus) between the well casing and the production tubing. At one or more predetermined locations along the length of the production tubing, gas lift flow control valves permit the gas in the annulus to enter the production tubing. The principle of gas lift is that high-pressure gas is injected into casing migrates into the production tubing through one or more gas lift flow control valves thereby reducing the density of the fluids in the production tubing.

The gas lift flow control valves control the flow of pressurized gas from the well casing through a valve port into an interior of the production tubing. Mechanical elements of a gas lift system (e.g., multiple gas lift flow control valves) may allow surface injection pressure to open or close different gas lift flow control valves at different pressures (e.g., at different depths) or open all gas lift flow control valves.

SUMMARY

In an arrangement, a flow control device for injecting gas in a down-hole application is provided. The flow control device includes an elongated injection housing having an upper end and a lower end. An upper external seal extends around an outside surface of the injection housing at a first location along the length of the housing and a lower external seal extends around the outside surface of the injection housing at a second location along the length of the housing. An inlet port extends though the sidewall of the injection housing between the upper external seal and the lower external seal. A first reverse flow check valve is disposed within the interior of the injection housing. Typically, the first reverse flow check valve is disposed along a length of the injection housing between the inlet port and the lower external seal. A second reverse flow check valve disposed is proximate to the lower end of the injection housing. The second reverse flow check valve is disposed along in a flow path though the injection housing between the inlet port and an outlet port in series with the first reverse flow check valve.

In another arrangement, a reverse flow check valve assembly for a down-hole gas injection device is provided. The check valve assembly includes an annular housing having an inlet end and an outlet end. Injection gases flow through an interior of the housing between the inlet end and the outlet end. An annular valve seat is disposed within the interior of the housing. A check dart also disposed within the interior of the housing is configured to move between a closed position where a valve head is seated against the valve seat and an open position where the valve head is spaced from the valve seat. At least one fluid flow path extends around the check dart and fluidly connects the inlet end of the housing and the outlet end of the housing when the check dart is in the opening position. The at least one fluid flow path extends through the housing at a location outward of an outer periphery of the valve head allowing fluid to flow around the check dart assembly rather than through the check dart assembly.

BRIEF DESCRIPTION OF THE DRAWINGS

FIG. 3A illustrates an exemplary cross-sectional view of a gas lift valve.

FIG. 3B illustrates a close-up view of a portion of the gas lift valve of FIG. 3A.

FIG. 3C illustrates a cross-sectional view of the gas lift valve transverse to the view of FIG. 3A.

DETAILED DESCRIPTION

Reference will now be made to the accompanying drawings, which at least assist in illustrating the various pertinent features of the present disclosure. The following description is presented for purposes of illustration and description and is not intended to limit the disclosed embodiments to the forms disclosed herein. Consequently, variations and modifications commensurate with the following teachings, and skill and knowledge of the relevant art, are within the scope of the presented embodiments.

Figure 1:
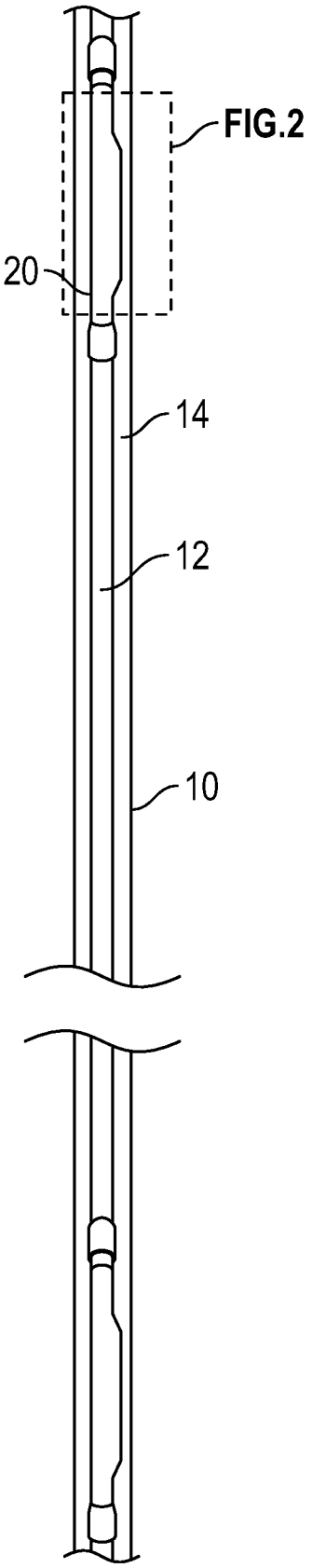
FIG. 1 illustrates an exemplary string of production tubing and side-pocket mandrels disposed in a well casing.
Figure 2:
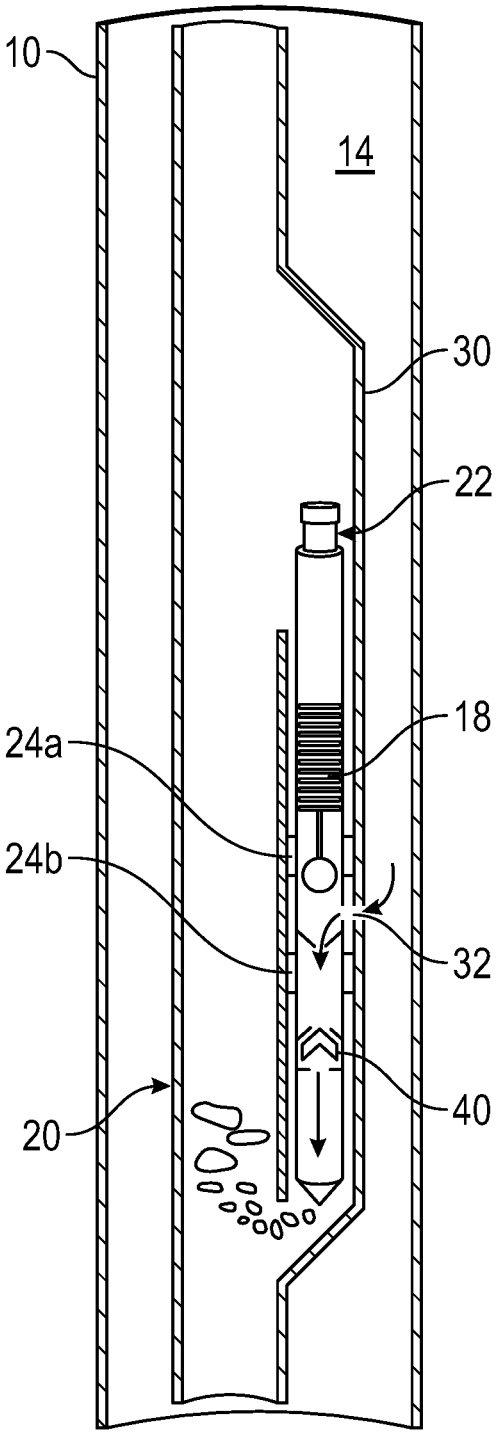
FIG. 2 illustrates an exemplary cross-sectional view of a side-pocket mandrel in a well casing and a gas lift valve.

FIG. 1 is a schematic illustration of an exemplary installation of a gas lift arrangement. As illustrated, an exemplary string of production tubing 12 is disposed within casing 10 of an oil and gas well forming an annulus 14 between an outside surface of the production tubing 12 and an inside surface of the casing 10. In the illustrated embodiment, one or more side pocket mandrels 20 are disposed along the production string 12 at predetermined subterranean locations. Each mandrel 20 may internally support a gas lift valve 22 (e.g., flow control device), which may open and/or close based on pre-determined pressure settings or continuously inject compressed gas from the annulus into the production tubing. As shown in FIG. 2, the side pocket each mandrel 20 is tubular member having first and second open-ends that are adapted for in-line connection with the production tubing 12. In this regard, one or both ends may be threaded and/or include a collar. The mandrel 20 further includes a side pocket offset 30 from the inner tubing diameter that receives and supports the gas lift valve 22. The pocket's upper end has a seating profile (not shown) for engaging a latch of the gas lift valve 22, while the pocket's other end may be open. One or more side ports 32 in the mandrel pocket communicate with the surrounding annulus 14 outside the mandrel 20 and allow for fluid communication between the annules and production tubing during gas lift operations. More specifically, a source of pressurized gas (not shown) may be injected down the well in the annulus 14 between the well-casing 10 and the production tubing 12. The gas lift valve 22 supported by the mandrel 20 may inject gas from the annulus into the production tubing 12. The gas injected into the production tubing expands and flows to the surfaces thereby lifting the liquid within the production tubing and reducing the density and column weight of the fluid in the tubing.

The gas lift valve 22 can be installed in the mandrel 20 during the initial installation of the production tubing. That is, the gas lift valve may be installed at the surface so that the mandrel 20 with installed gas lift valve 22 can be run downhole together without the need for a wireline operation. However, the gas lift valve 22 may also be lowered down the production tubing 12 to a side-pocket mandrel 30 already installed downhole using a wireline operation. Additionally, the gas lift valve may be removed from an installed mandrel via a wireline operation. Upon installation, external packing elements 24*a*, 24*b* seal above and below the mandrel inlet ports 32, isolating the annulus from the tubing in the side-pocket mandrel. Though discussed primarily in relation to a system that utilizes side pocket mandrels, it will be appreciated that the flow control devices discussed herein may be utilized with other mandrels that may incorporate, for example, externally mounted flow control devices.

As further illustrated by the exemplary gas lift valve illustrated in FIG. 3A, the gas lift valve 22 may be a pressure-operated gas lift valve, such as an injection pressure operated valve, or a production pressure operated valve. The upper and lower seals 24*a*, 24*b*, in addition to packing off the mandrel ports when disposed within a mandrel pocket, also straddle and packoff one or more inlet ports 26 that extends into a body of the valve 22. In a common embodiment, a valve stem 28 is biased closed by a gas charge chamber 16 and bellows 18. At its forward end, the valve stem 28 moves a ball 36 relative to a valve seat/orifice 38 in a fluid flow path between the valve inlet port(s) 26 and a valve outlet port 27 in response to counteracting pressures exerted on the bellows from pressurized fluids in the annulus 16 (i.e., via the inlet ports(s) 26) and by the pressurized gas charge chamber 16. Commonly, a predetermined gas charge applied to the gas charge chamber 16 and bellows 18 biases the valve piston against the valve seat closing the valve in the absence of sufficient casing pressure.

Typically, it is desirable that flow through the valve be unidirectional. In this regard, a check dart 40 may be positioned in the flow path through the valve downstream of the valve inlet port 26. Such a check dart 40 may keep fluids from within the production tubing 12 from reverse flowing through the inlet port(s) 26 and back into the annulus 16. That is, when pressure within the casing is greater than a pressure in the production tubing in the illustrated embodiment, gas passes through the valve 22 pushing the check dart downward (i.e., right as shown in FIG. 3A). In this situation, injection gases from the casing flow through ports 42 formed at least partially through the check dart 40 and continue into the production tubing. See also FIGS. 3B and 3C. When fluid pressure within the production tubing is greater than the pressure in the casing, pressurized fluids entering the exit port(s) 27 of the valve 22 and compresses the check dart 40 against a valve seat 44. When compressed against the valve seat 44, the check dart substantially prevents reverse flow through the valve.

There are various drawbacks in relation to the injection valve illustrated in FIGS. 3A-3C. One drawback is that injection fluid flow is typically routed through ports 42 extending through the body of the check dart 40. Over time, high-pressure fluid flow tends to erode material around the ports 42. Such erosion can result in the check dart 40 failing to seal when pushed against the valve seat in response to reverse flows. That is, erosion may affect the valve face on the check dart such that the check valve (e.g., check dart and valve seat) fails to withstand reverse pressure flows. Once such erosion occurs, the valve 22 may have to be replaced by, for example, a wireline operation or by pulling the production tubing from the well. Either operation tends to be expensive especially in deep-water applications. Another drawback is that flow through the ports 42 of the check dart tends to restrict or choke the flow through the valve. Accordingly, embodiments disclosed herein are directed to injection valves for flow control devices having improved reverse flow characteristics.

Figure 4A:
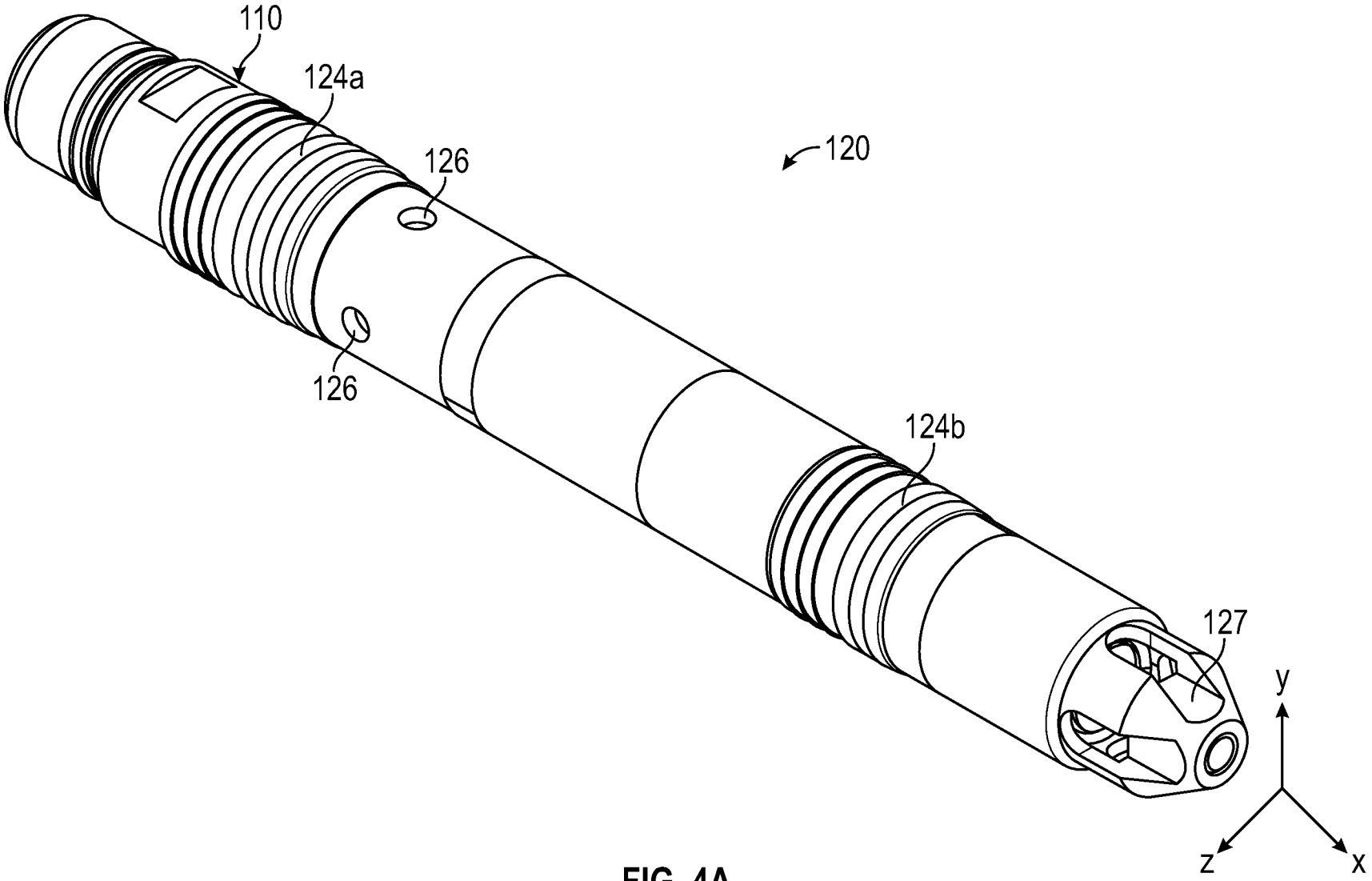
FIG. 4A illustrates a perspective view of a gas lift valve, in an embodiment.
Figure 4B:
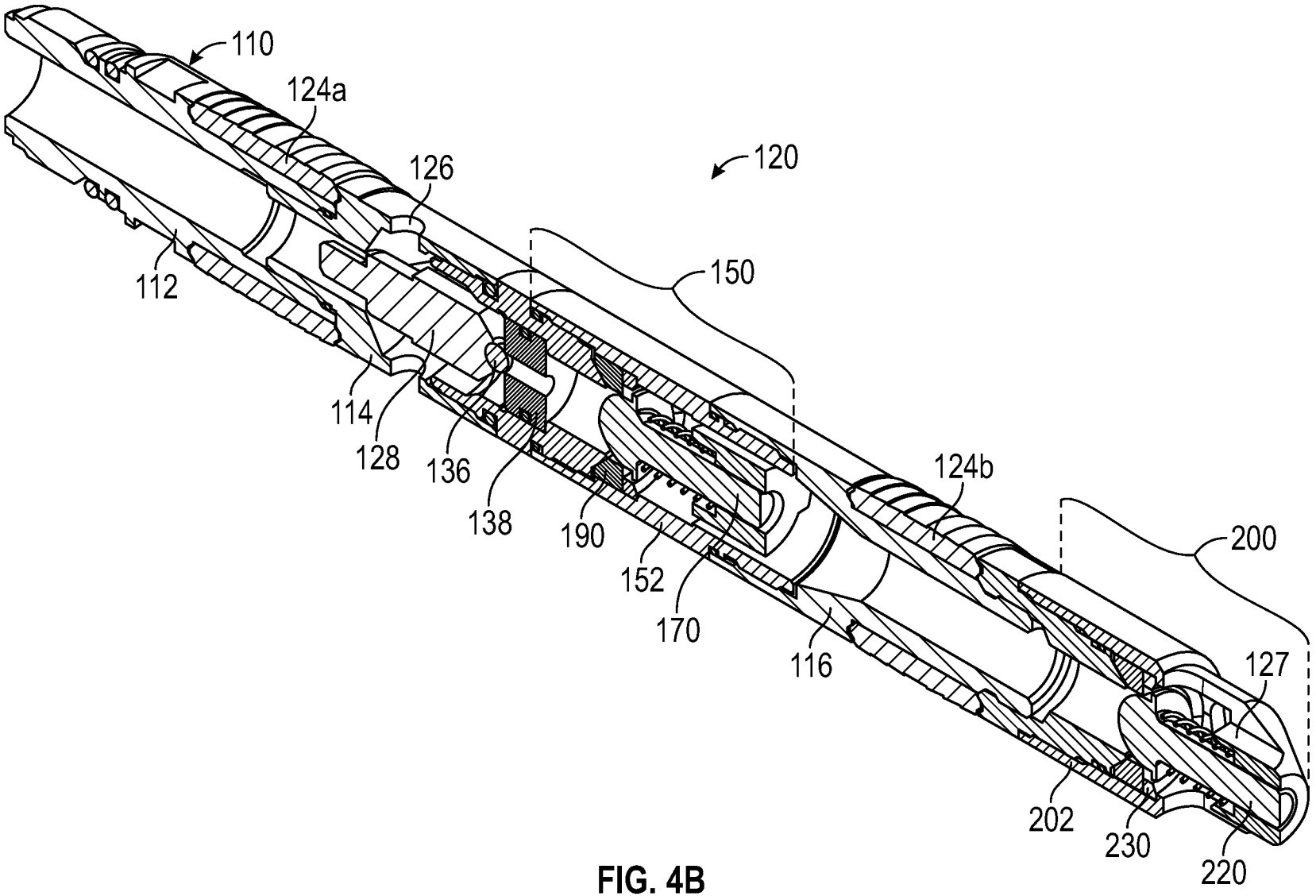
FIG. 4B illustrates a cross-section view of the gas lift valve in a first plane, in an embodiment.
Figure 4C:
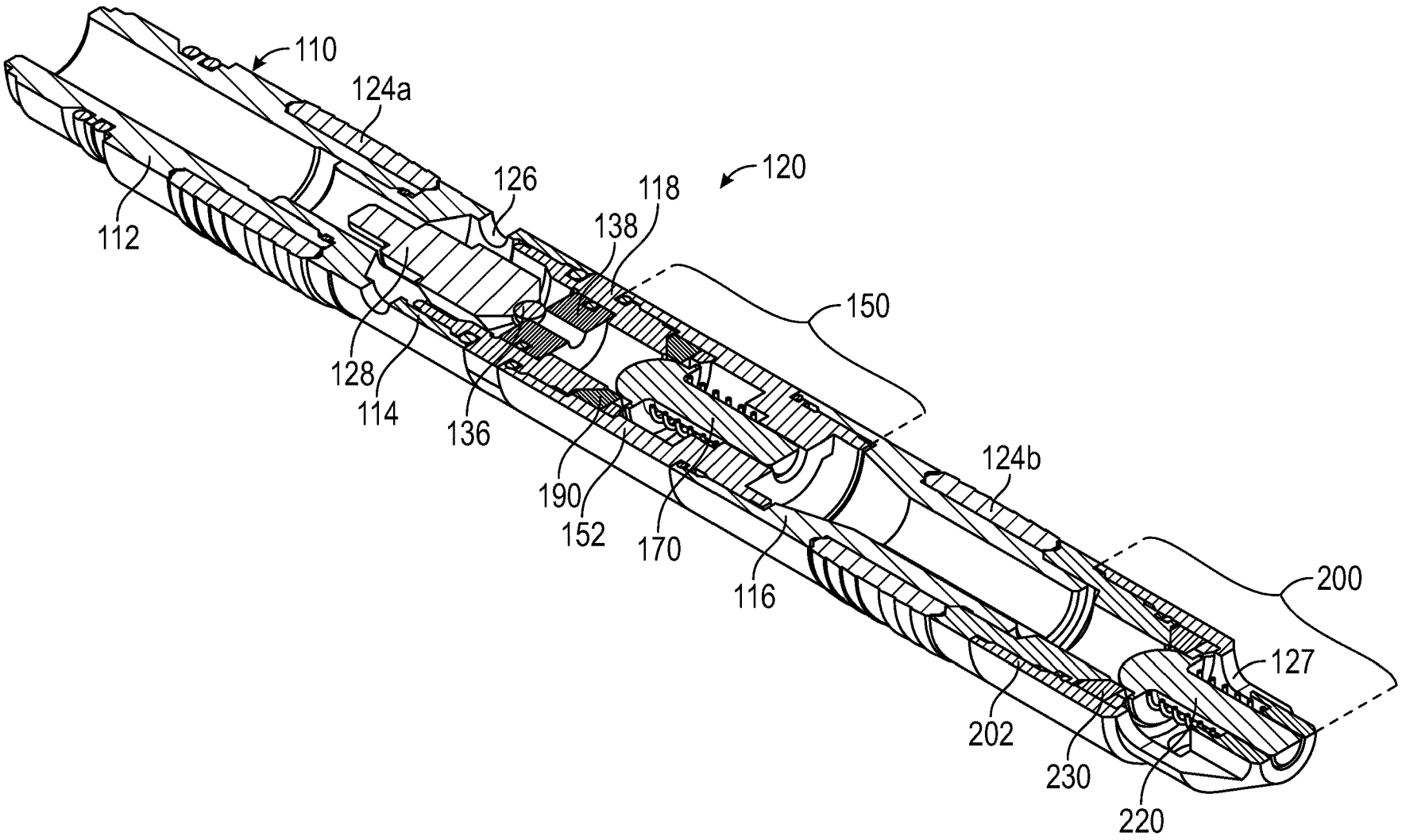
FIG. 4C illustrates a cross-section view of the gas lift valve in a second plane, in an embodiment.

FIG. 4A illustrates one embodiment of a gas lift valve 120 according to an embodiment. FIGS. 4B and 4C illustrate cross-sectional views taking along a long axis of the gas lift valve 120 in transverse planes. Specifically, FIG. 4B illustrates a cross-section of the gas lift valve 120 in the xy plane and FIG. 4C illustrates a cross-section of the gas lift valve 120 in the xz plane, both taken along a centerline of the valve. Generally, the gas lift valve is defined by an elongated housing 110 (e.g., injection valve housing or injection housing) that extends between one or more inlet ports 126 and one or more outlet ports 127. The valve 120 includes several components common to the valve 22 discussed above in relation to FIG. 3A. For instance, the current valve 120 includes first and second exterior seals 124*a*, 124*b* (e.g., elastomeric packing stacks) disposed above and below, respectively, the one or more inlet ports 126 extending though a sidewall of the housing 110 of the valve 120 into an interior of the valve. The illustrated embodiment of the gas lift valve 120 also includes a valve stem 128 that advances and retracts a valve ball 136 relative to a valve seat and orifice 138. The orifice may be sized to provide a desired flow rate through the valve. Additionally, the valve stem 128 may be attached to a bellows and gas charge chamber, like those discussed above in relation to FIG. 3A. These elements are omitted from the illustrated embodiment as being well understood by those skilled in the art. In an alternative embodiment (not shown), the valve 120 may be an orifice valve that allows continuous gas injection through the inlet port(s). In such an embodiment, the valve stem, valve ball and valve seat may be omitted. The injection housing may be formed of a plurality of interconnected generally annular components. For instance, the injection housing may include an inlet housing 114 having an upper end connected to an upper packer housing 112 (e.g., bellows adapter) and a lower end that connects to an upper end of a seat housing 118. The lower end of the seat housing 118 connects an upper end of first valve assembly housing 152. A lower end of the first valve assembly housing 152 has a lower end connected to an upper end of a lower packer housing 116, which connects to an upper end of a second valve assembly housing 202. Collectively, these components define the elongated housing 110 of the injection valve 120.

In the illustrated embodiment, the valve 120 utilizes a first reverse flow check valve assembly 150 disposed in series with a second reverse flow check valve assembly 200. The use of two reverse flow check valve assemblies (i.e., an upper check valve assembly 150 and a lower check valve assembly 200) disposed in series provides a redundancy for the valve 120. In this regard, if one of the reverse flow check valve assemblies fails, the other reverse flow check valve assembly may provide adequate reverse flow protection thereby eliminating the need to replace the valve. Such redundancy may significantly extend a service life of an injection valve and/or provide significant operational savings through reduced servicing. In addition to providing redundancy for the valve, each of the reverse flow check valves 150 and 200 include various novel features alone as well as in combination.

As illustrated in FIGS. 4A-4C, the two reverse flow check valve assemblies 150, 200 are disposed in a flow path through the interior of the injection valve 120 between the inlet ports 126 through a sidewall of the valve and outlet ports 127 located at the bottom end (e.g., nose) of the valve 120. The use of two reverse flow check valve assemblies in series requires that one of the assemblies be disposed entirely within the interior of the valve 120. In the illustrated embodiment, the upper check valve assembly 150 is disposed entirely within an interior of the valve 120. The illustrated embodiment of the injection valve 120 incorporates the upper check valve 150 assembly at a location along a length of the valve 120 between the first and second exterior seals 124*a*, 124*b*. Such positioning allows incorporation of the two check valves in series while allowing the valve to be used with, for example, existing side pocket mandrels having preexisting spacing between the mandrel inlet ports and latching assemblies. The positioning of a check valve assembly entirely within the interior of the valve (e.g., within a sidewall of the valve) has previously resulted in a choke point through the valve as the injection flow is typically routed through ports in the body of the check dart as discussed above. That is, as opposed to the lower check valve assembly 200, which can exhaust fluid flow through apertures 127 extending through the sidewall of the valve assembly 200, the upper check valve assembly 150 is contained within the sidewall of the injection valve 120 and the injection flow must pass by the upper check valve assembly 150 while remaining within the confines of the valve sidewall.

Figure 5A:
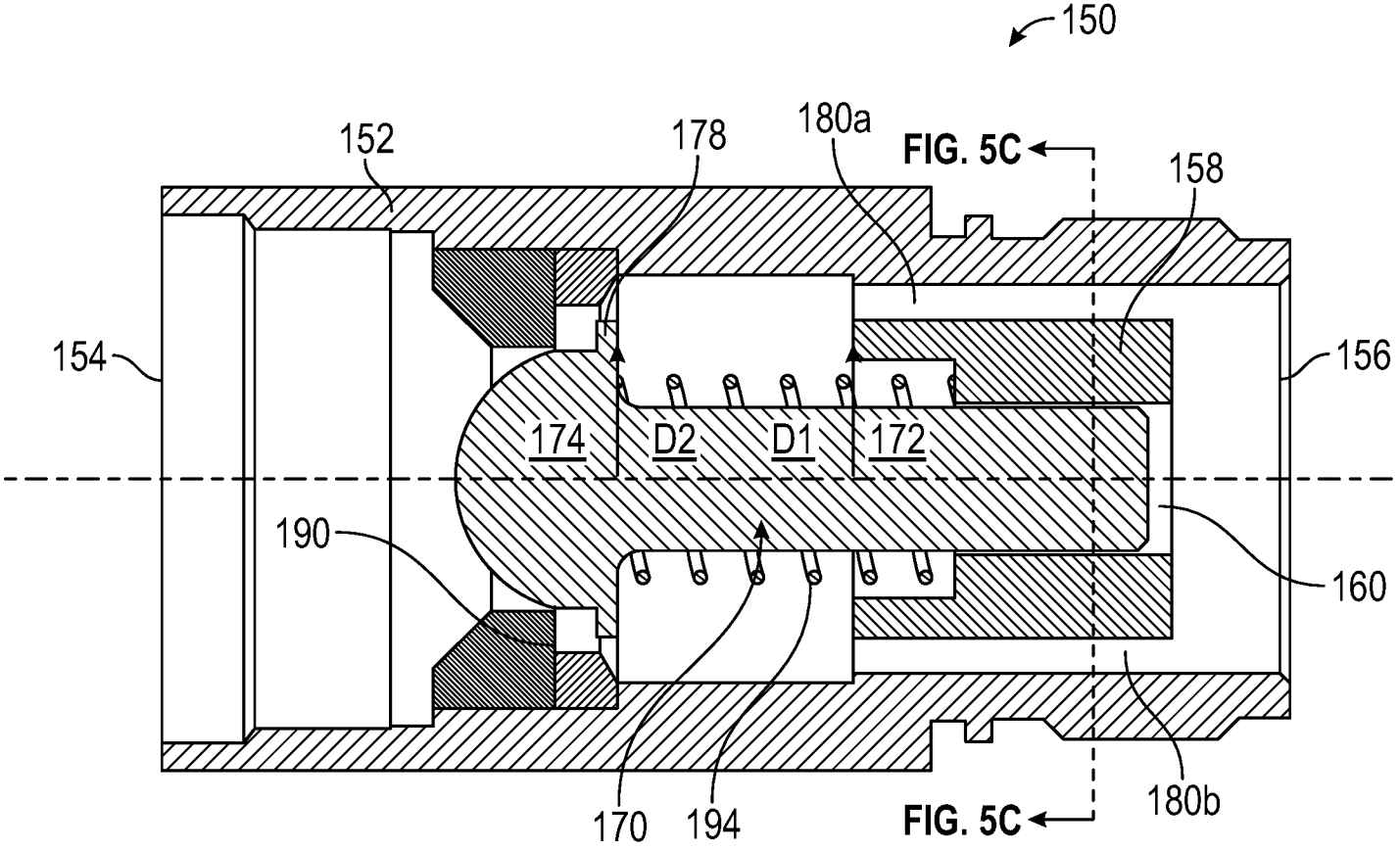
FIG. 5A illustrates a side cross-sectional view of a check valve assembly in an embodiment.
Figure 5B:
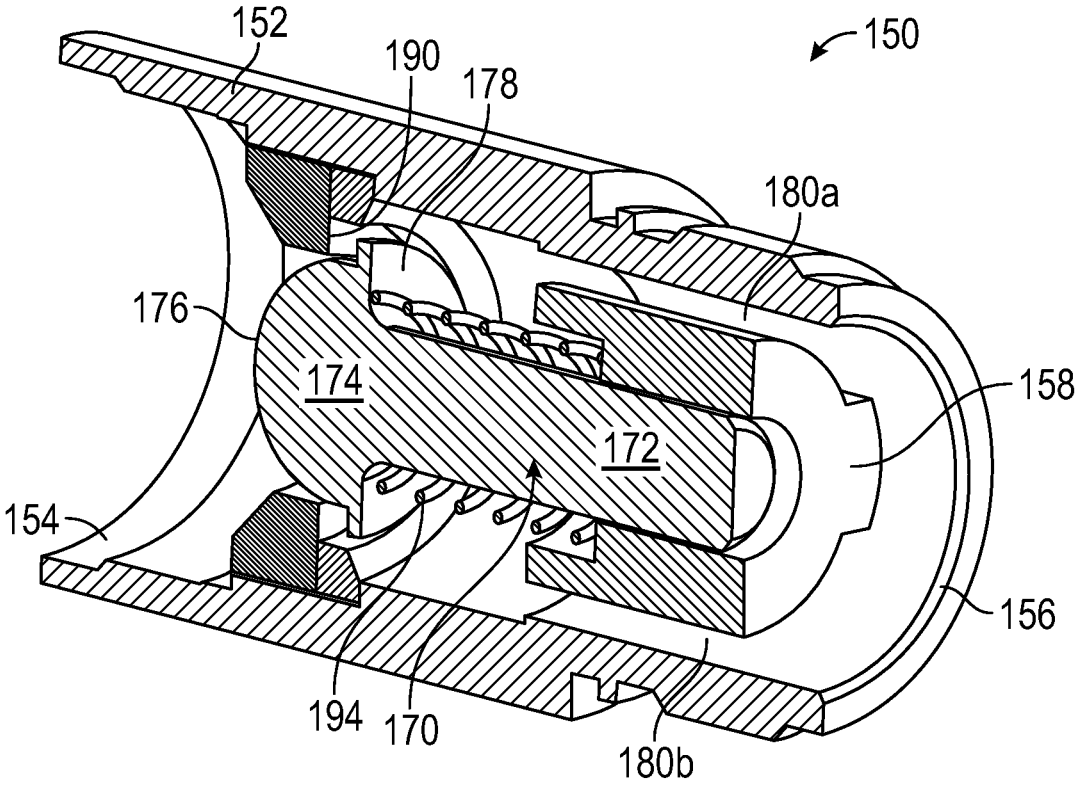
FIG. 5B illustrate a perspective cross-sectional view of the check valve assembly of FIG. 5A, in an embodiment.

FIGS. 5A and 5B illustrate a side cross-sectional view and a perspective cross-sectional view in the xy plane, respectively, of the upper check valve assembly 150. The check valve assembly 150 includes three primary components, an annular check valve housing 152, a check dart 170 and an annular elastomeric check pad or valve seat 190. As variously illustrated, the check valve housing 152 is a generally cylindrical member having at least a first flow path extending through is interior from an inlet end 154 to an outlet end 156. The elastomeric valve seat 190 has an open interior and is disposed within the housing 152 toward the inlet end. The check dart 170 moves relative to the elastomeric valve seat 190 to open and close a flow path through the valve.

The housing 152 may include internal threads (not shown) formed about the interior surface of the generally open inlet end 154. In the illustrated embodiment, the seat housing 118 threads into the open inlet end 154 of the valve housing 152. The lower end of the seat housing 118 may trap or compress the elastomeric valve seat 190 within the housing. Likewise, the housing 152 may include external threads (not shown) formed on an exterior surface of the outlet end 156. In this regard, the check valve assembly 150 may be threaded to adjacent components of the injection valve 120. Along these lines, it will be appreciated that a sidewall of the injection valve 120 may include several annular components threaded together to collectively define the overall sidewall of the injection valve 120. Further, it will be appreciated that the inlet end and outlet end of the check valve housing 152 may include external and external threads, respectively, and the illustrated embodiment is presented by way of illustration and not limitation.

The housing 152, while including a flow path between its inlet and outlet ends, is not a hollow member. That is, while the inlet end and outlet end may be substantially hollow, a check dart support 158 extends across a portion of the interior of the housing 158 to movably support the check dart 170 relative to the annular valve seat 190. The support 158, in its simplest form, is a structure (e.g., wall or divider) that extends across an interior of the annular housing 152 and provides a structure for supporting the check dart 170. The support at least partially divides the inlet end of the housing 152 from the outlet end of the housing 152. In the illustrated embodiment, the support 158 includes a central aperture 160 that receives a lower stem or valve stem 172 of the check dart 170. In the illustrated embodiment, the central aperture 160 is aligned with a centerline axis of the housing 152.

The check dart 170 includes the valve stem 172 and a valve head 174 attached to the upper end of the stem 172. In the illustrated embodiment, the valve head has a V upper surface 176 and a generally flat annular flange 178 extending about a periphery of the upper domed surface 176. In the illustrated embodiment, an upper surface of the flat annular flange 178 is configured to engage a bottom surface of the elastomeric valve seat 190 (e.g., check pad) while the domed upper surface 176 extends through an open interior of the elastomeric valve seat 190. During operation, once the annular flange 178 contacts the annular valve seat, the seat may compress allowing the domed upper surface to contact a chamfer 192 of an upper mating part (e.g., seat housing 118 See FIG. 5D), serving as a secondary metal to metal seal. In this regard, the annular flange 178 and the elastomeric valve seat 190 may form a primary seal and the domed surface 176 and a chamfered end 192 of the seat housing 118 may form a secondary seal. In the illustrated embodiment, the check dart 170 is biased against the valve seat 190 by a coil spring 194 (e.g., bias force member) disposed around the valve stem 172 and between a bottom surface of the valve head 174 and an upper surface of the valve stem support 158. As illustrated, the upper surface of the valve stem support 158 may include an annular recess that houses a lower end of the spring 194.

The spring 194 may, in the absence of injection flows (e.g., injection pressure) moving through the valve assembly 150 between the inlet end 154 and the outlet end 156, compress the valve dart 170 against the valve seat 190 to maintain the valve in a closed position and thereby prevent reverse fluid flows (i.e., moving between the outlet end 156 and the inlet end 154) passing through the check valve assembly 150. Further, reverse fluid flows may apply pressure the lower side of the valve head 174 thereby compressing the valve head against the elastomeric valve seat 190. When injection flows are moving through the assembly 150 between the inlet end 154 and outlet end 156, the pressure of the injection flow contacts the domed upper surface 176 of the valve dart 170 compressing the spring 194. This results in the valve stem 172 moving through the central aperture of the valve support 158 while the valve head 174 moves away from the valve seat 190 thereby opening the check valve assembly 150.

Figure 5C:
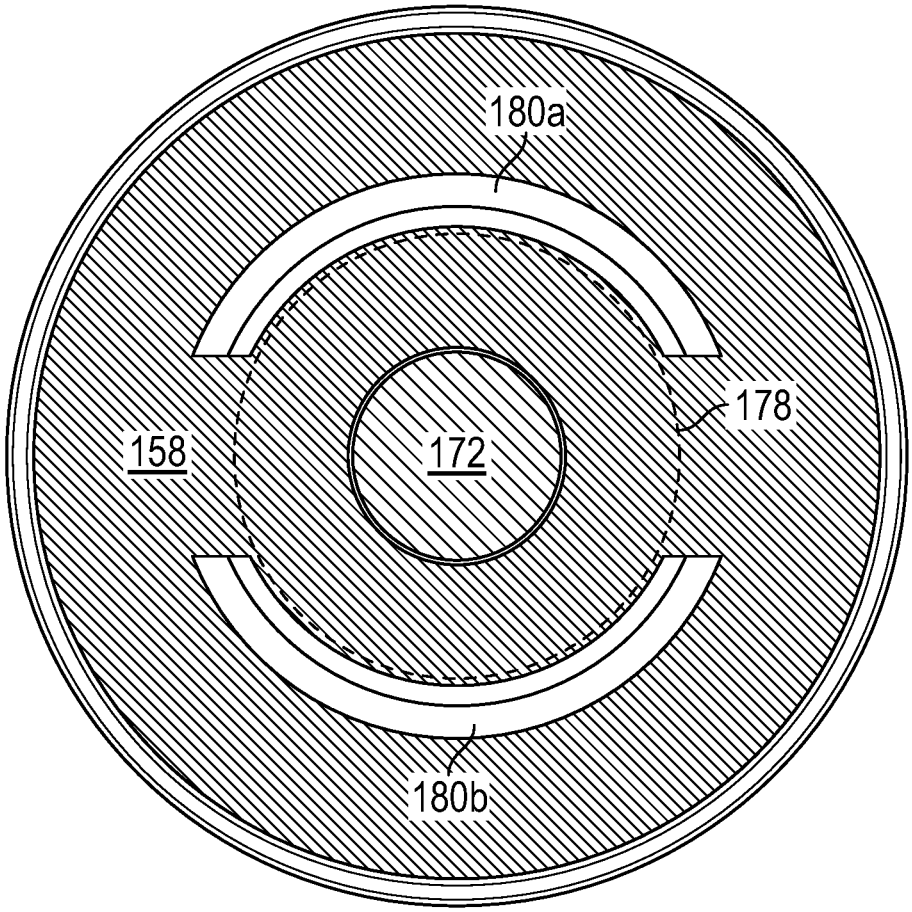
FIG. 5C illustrate a cross-sectional view of the check valve assembly transverse to the view of FIG. 5A, in an embodiment.
Figure 5D:
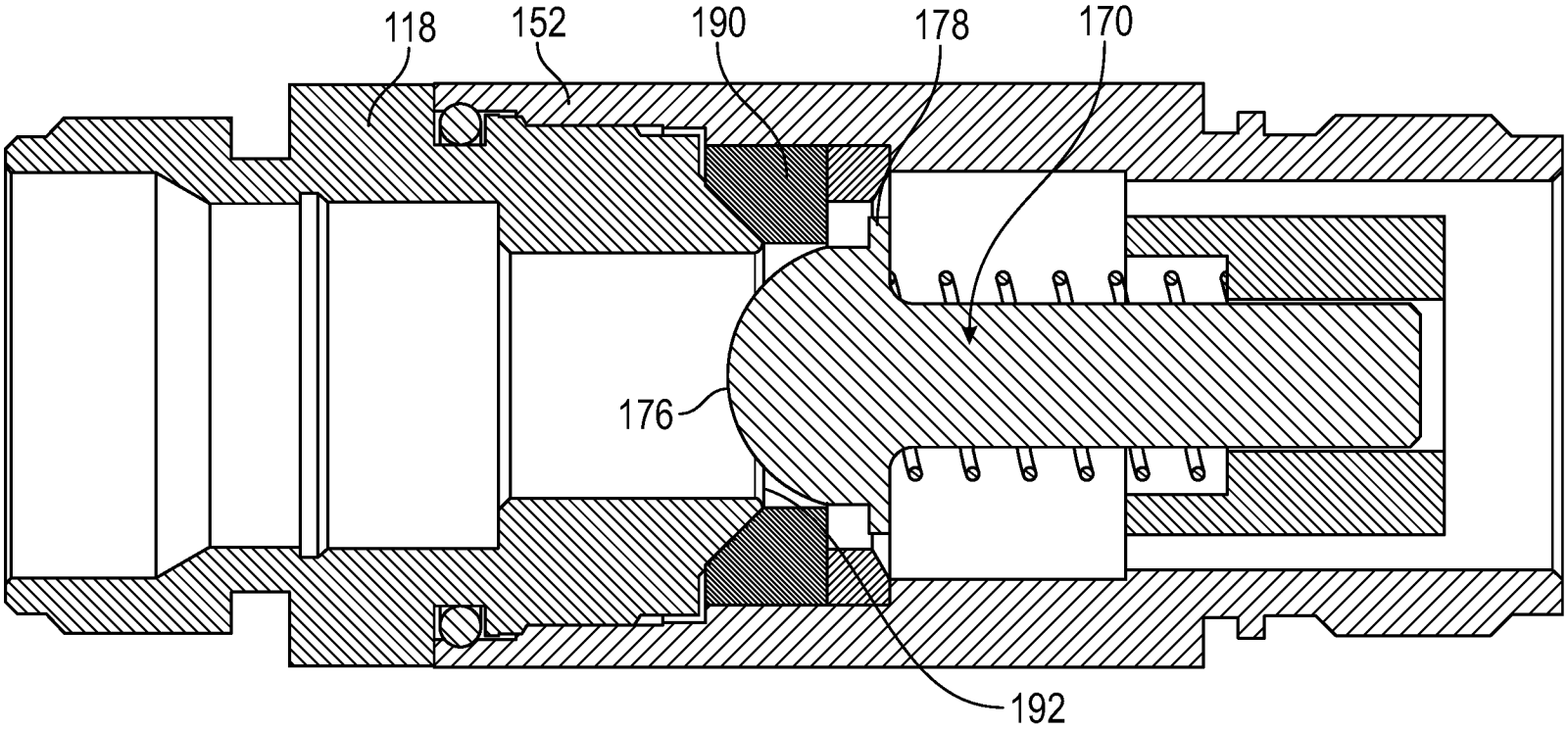
FIG. 5D illustrates a side cross-sectional view of a check valve assembly of FIG. 5B attached to a mating component, in an embodiment.

Once the valve dart 170 move to an open position (not shown), the injection fluid flow must pass across the valve dart 170 and valve dart support 158. As noted above, prior reverse flow check valve assemblies utilizing ports through a body of the valve dart have resulted in a choke point in the fluid flow through the assembly. To avoid such a choke point, the illustrated embodiment of the check valve assembly utilizes one or more fluid flow passages 180*a*, 180*b* that streamlined around the check dart 170. Specifically, the check valve assembly 150 utilizes two flow path 180*a*, 180*b* that extend through the valve dart support 158 at a location radially outward from the outer peripheral edge (e.g., annular flange 178) of the valve head 174. As best illustrated in FIG. 5A, the check dart 170 is formed of generally cylindrical/circular components and a centerline axis of the check dart 170 (e.g., long central axis of the valve stem) is aligned with a centerline axis A-A' of the annular housing 152. In the present embodiment, the interior edge of the flow path(s) 180*a*, 180*b* as measured from the centerline axis A-A' is located a distance D1 that is equal to or greater than a distance D2 of the outer peripheral edge of the valve head 174 (i.e., outer edge of flat annular flange 178 in the present embodiment) as measured from the centerline axis A-A'. This is also illustrated in FIG. 5C, which is a cross-sectional view of the valve assembly taken through the dart support 158. The remainder of each flow path 180*a*, 180*b* (i.e., to its exterior edge measured from the centerline axis) is disposed outward from the outer peripheral edge of the valve head. As illustrated, each of the flow paths 180*a*, 180*b* are arcuate/radial channels (e.g., generally D-shaped channel) extending through the valve dart support. Though illustrated as having two flow paths 180*a*, 180*b*, it will be appreciated that more or fewer flow paths may be utilized.

Positioning the flow paths 180 at a location radially outward from the outward peripheral edge of the of the valve head 174 provides several benefits. One benefit is that injection fluid flows do not pass directly over or through a sealing surface (valve face) of the valve head. Accordingly, erosion of the valve face is reduced or eliminated significantly extending the service life of the check valve. Another benefit is that the overall cross-sectional size of the flow paths or flow area may be significantly increased relative to flow areas of prior flow paths extending through the body of a check dart. In embodiments, the flow area of the one or more flow paths may exceed the cross-sectional area of an orifice into an injection valve and/or the cross-sectional area of the interior of the valve seat. In this regard, the flow area across the check dart may be equal or greater in size than upstream passageways. Accordingly, the radial outward flow paths around the check dart do not result in a restriction or choke point through an injection valve utilizing the reverse flow check valve assembly 150.

Figure 6A:
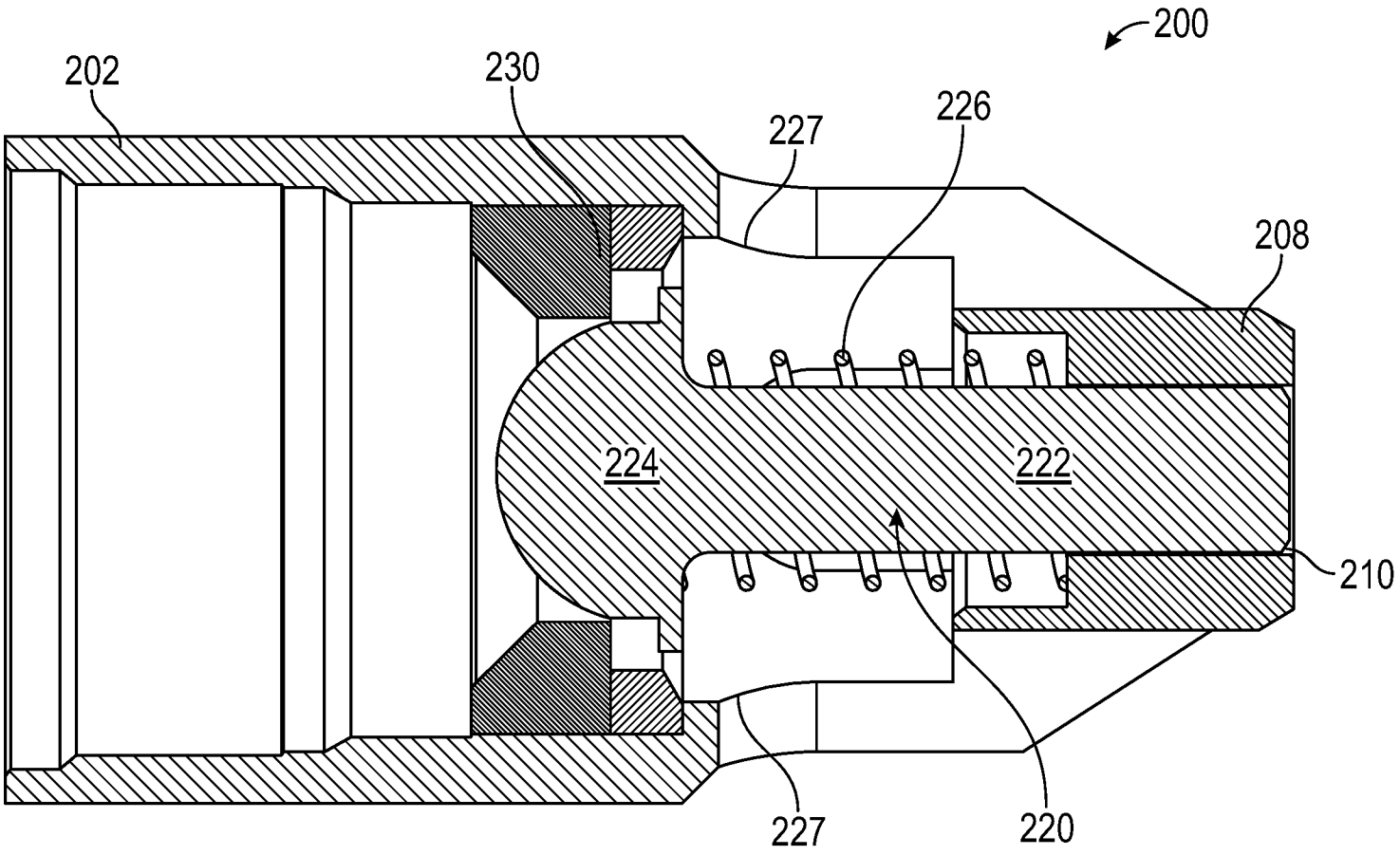
FIG. 6A illustrates a side cross-sectional view of another check valve assembly in an embodiment.
Figure 6B:
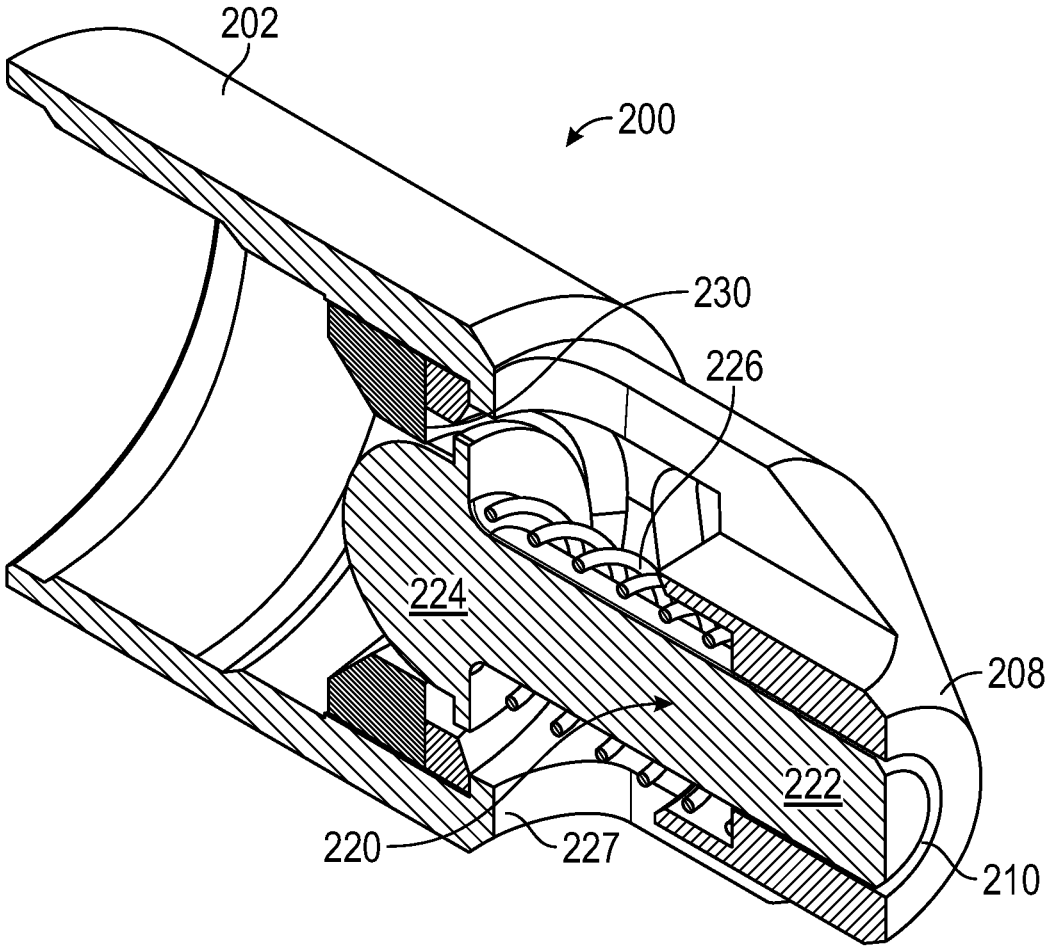
FIG. 6B illustrate a perspective cross-sectional view of the check valve assembly of FIG. 6A, in an embodiment.

FIGS. 6A and 6B illustrate a side cross-sectional view and a perspective cross-sectional view, respectively, of the second or lower reverse flow check valve assembly 200. The check valve assembly 200 includes a check valve housing 202, a check dart 220 and an annular valve seat 230. As variously illustrated, the housing 202 is a generally cylindrical member having a generally hollow inlet end 204. The annular valve seat 230 is disposed within an interior of the housing 202 toward the inlet end. The annular valve seat 230 may be press fit into the interior of the housing, threadedly engaged with the housing and/or integrally formed with the housing. The check dart 220 moves relative to the valve seat 230 to open and close a flow path through the valve assembly 200.

The check valve housing 202 extends from the open inlet end to a check dart support 208, which movably supports the check dart 220 relative to the annular valve seat 230. The support 208 includes a central aperture 210 that receives a lower end of the check dart. The check dart 220 includes the valve stem 222 and a valve head 224 attached to the upper end of the stem 222. In the illustrated embodiment, the valve head has a domed upper surface and a generally flat annular flange extending about a periphery of the upper domed surface. Other configurations are possible. In the illustrated embodiment, an upper surface of the flat annular flange is configured to engage a flat bottom surface of the annular valve seat 230 (e.g., check pad) while the domed upper surface extends through an open interior of the annular valve seat. In the illustrated embodiment, the check dart 220 is biased against the annular valve seat 230 by a coil spring 226 disposed around the valve stem 222 and between a bottom surface of the valve head 224 and an upper surface of the valve stem support 208. The check valve assembly 200 operates substantially like the check valve assembly discussed above in relation to FIGS. 5A-5C with the exception that injection fluids passing through the valve exit through ports 227 in the housing 202 between the check dart support 208 and middle-portion of the housing 202 proximate to the valve seat. Stated otherwise, the valve assembly vents fluid through a sidewall of the housing after the fluid pass through the check dart and valve seat.

The housing 202 includes include internal threads (not shown) formed about an interior periphery of the hollow inlet end 204. In other embodiments, the valve assembly 200 may include external threads about an exterior periphery of the hollow inlet end. In any embodiment, the check valve assembly 200 may be attached to a lower end or nose of an injection valve. See, e.g., FIG. 4A. One of the novel features of the check valve assembly 200 of FIGS. 6A and 6B is that the assembly 200, which may be attached to the lower end/nose of a valve, includes both the check dart and the valve seat. Prior nose valve check assemblies have typically utilized a check dart that engages an interior annular surface of a component to which the nose valve check assembly housing connects. That is, the valve seat is attached or integrally formed with a component other than the nose valve check assembly. In such arrangements, if the nose valve check assembly fails, two components must be removed from the valve and replaced to repair the valve rather than replacing a nose valve check assembly with and integrated valve seat.

Additional difficulties arise when repairing downhole injection valves. Most notably, most downhole equipment must pass prescriptive testing requirements. In the case of reverse flow check valves, such requirements must be passed prior to certify a device as a "Barrier" device. The testing requirements needed to certify a reverse flow check valve as a Barrier device are set for in API spec 19G2 as the V0 validation grade. By incorporating the valve seat into a common housing with the check dart as set forth above in the valve assembly 200 of FIGS. 6A and 6B, the valve assembly 200 may be tested and certified prior to the valve assembly 200 being connected to an injection valve device. The ability to certify the valve assembly prior to its use also allows for redressing injection valve assemblies in the field. That is, a technician may remove a nose valve check assembly that has filed (e.g., allows reverse flow) and replace the entire assembly with a pre-certified nose valve check assembly, and reinstall the injection valve in the well. Previously, the entire injection valve assembly would have to be replaced and the damaged assembly would have to be repaired and recertified. It will further be appreciated that the check valve assembly 150 of FIGS. 5A-5C could likewise be certified as a Barrier device the assembly also includes the check dart and valve seat in a common housing.

All directional references (e.g., plus, minus, upper, lower, upward, downward, left, right, leftward, rightward, top, bottom, above, below, vertical, horizontal, clockwise, and counterclockwise) are only used for identification purposes to aid the reader's understanding of the present disclosure, and do not create limitations, particularly as to the position, orientation, or use of the any aspect of the disclosure. As used herein, the phrased "configured to," "configured for," and similar phrases indicate that the subject device, apparatus, or system is designed and/or constructed (e.g., through appropriate hardware, software, and/or components) to fulfill one or more specific object purposes, not that the subject device, apparatus, or system is merely capable of performing the object purpose. Joinder references (e.g., attached, coupled, connected, and the like) are to be construed broadly and may include intermediate members between a connection of elements and relative movement between elements. As such, joinder references do not necessarily infer that two elements are directly connected and in fixed relation to each other. It is intended that all matter contained in the above description or shown in the accompanying drawings shall be interpreted as illustrative only and not limiting. Changes in detail or structure may be made without departing from the spirit of the invention as defined in the appended claims.

Any patent, publication, or other disclosure material, in whole or in part, that is said to be incorporated by reference herein is incorporated herein only to the extent that the incorporated materials does not conflict with existing definitions, statements, or other disclosure material set forth in this disclosure. As such, and to the extent necessary, the disclosure as explicitly set forth herein supersedes any conflicting material incorporated herein by reference. Any material, or portion thereof, that is said to be incorporated by reference herein, but which conflicts with existing definitions, statements, or other disclosure material set forth herein will only be incorporated to the extent that no conflict arises between that incorporated material and the existing disclosure material.

What is claimed is:

1. A flow control device for injecting gas in a down-hole application, comprising:

an injection housing having an upper end, a lower end, an upper external seal extending around an outside surface of the injection housing and a lower external seal extending around the outside surface of the injection housing;

an inlet port extending though a sidewall of the injection housing between the upper external seal and the lower external seal;

a first reverse flow check valve disposed within the interior of the injection housing, wherein the first reverse flow check valve is disposed along a length of the injection housing between the inlet port and the lower external seal, the first reverse flow check valve having:

a first check dart having a first valve head, wherein the first check dart is configured to move between a closed position relative to a first annular valve seat where the first valve head is seated against the first annular valve seat and an open position where the first valve head is spaced from the first annular valve seat, and at least one fluid flow channel extending through a portion of the injection housing and around at least a portion of the first check dart, the fluid flow channel fluidly connecting an inlet end of the injection housing and an outlet end of the injection housing when the first check dart is in the open position, wherein a radially interior edge of the at least one fluid flow channel, as measured from a centerline axis of the injection housing, extends through the injection housing at a location radially outward of an outer periphery of the first valve head, wherein a combined cross-sectional area of the at least one flow channel is equal to or greater than a cross-sectional area of an orifice in the flow path upstream of the first reverse flow check valve; and a second reverse flow check valve disposed proximate to the lower end of the injection housing, wherein the second reverse flow check valve is disposed along in a flow path though the injection housing between the inlet port and an outlet port in series with the first reverse flow check valve.

2. The device of claim 1, wherein the second reverse flow check valve is located along the length of the injection housing above the lower external seal.

3. The device of claim 1, wherein the first reverse flow check valve comprises:

a first check valve housing connected to an upper component of the injection housing and a lower component of the injection housing, wherein the first check valve housing forms a portion of the injection housing.

4. The device of claim 3, further comprising:

a first spring configured to bias the first valve head toward the first valve seat.

5. The device of claim 3, wherein the second reverse flow check valve comprises:

a second check valve housing having a generally hollow inlet end, wherein the inlet end of the second check valve housing includes threads for attaching the second check valve housing to an adjacent component of the injection housing;

a second annular valve seat disposed within the interior of the second check valve housing; and a second check dart disposed within the interior of the second check dart housing between the second annular valve seat and an outlet end of the second check dart housing, the second check dart having a second valve head, wherein the second check dart is configured to move between a closed position where the second valve head is seated against the second valve seat and an open position where the second valve head is spaced from the second valve seat.

6. The device of claim 5, wherein the second reverse flow check valve is located along the length of the injection housing below the lower external seal.

7. The device of claim 5, further comprising:

a second spring configured to bias the second valve head toward the second valve seat.

8. The device of claim 1, wherein the at least one fluid flow channel comprises:

a radial channel extending though a portion of the injection housing.

9. A reverse flow check valve assembly for a down-hole gas injection device, comprising:

an annular housing having an inlet end and an outlet end, wherein injection gas may flow through an interior of the housing between the inlet end and the outlet end; an annular valve seat disposed within the interior of the housing;

a check dart disposed within the interior of the housing between the inlet end and the outlet end, the check dart having a valve head, wherein the check dart is configured to move between a closed position where the valve head is seated against the valve seat and an open position where the valve head is spaced from the valve seat;

at least one fluid flow channel extending through a portion of the housing and around at least a portion of the check dart and fluidly connecting the inlet end of the housing and the outlet end of the housing when the check dart is in the opening position, wherein a radially interior edge of the at least one fluid flow channel, as measured from a centerline axis of the annular housing, extends through the housing at a location radially outward of an outer periphery of the valve head, wherein a combined cross-sectional area of the at least one flow channel is equal to or greater than a cross-sectional area of an open interior of the annular valve seal.

10. The assembly of claim 9, wherein the check dart is configured to move between the open position and the closed position along the centerline axis of the annular housing.

11. The assembly of claim 10, wherein an entirety of the at least one fluid flow path channel is disposed radially outward from the periphery of the valve head as measured from the centerline axis.

12. The assembly of claim 11, wherein the at least one fluid flow channel comprises:

a radial channel extending though the portion of the interior of the housing across the check dart.

13. The assembly of claim 9, further comprising:

a check dart support disposed within the interior of the housing, the check dart support extending across an interior of the housing and separating an inlet interior of the housing from an outlet interior of the housing, wherein the at least one flow channel extends through the check dart support.

14. The assembly of claim 13, wherein the check dart support comprises:

a central opening sized to receive a stem of the check dart; and a spring disposed between the check dart support and the check dart, wherein the spring biases the valve head toward the valve seat.

* * * * *